US009466411B2

(12) United States Patent
Oda et al.

(10) Patent No.: US 9,466,411 B2
(45) Date of Patent: Oct. 11, 2016

(54) NON-ORIENTED ELECTRICAL STEEL SHEET

(71) Applicant: JFE Steel Corporation, Tokyo (JP)

(72) Inventors: Yoshihiko Oda, Tokyo (JP); Hiroaki Toda, Tokyo (JP); Tadashi Nakanishi, Tokyo (JP); Yoshiaki Zaizen, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 14/345,086

(22) PCT Filed: Sep. 26, 2012

(86) PCT No.: PCT/JP2012/006141

§ 371 (c)(1),
(2) Date: Mar. 14, 2014

(87) PCT Pub. No.: WO2013/046661

PCT Pub. Date: Apr. 4, 2013

(65) Prior Publication Data

US 2014/0345751 A1 Nov. 27, 2014

(30) Foreign Application Priority Data

Sep. 27, 2011 (JP) ..... 2011-211553

(51) Int. Cl.
*C22C 38/00* (2006.01)
*H01F 1/147* (2006.01)
(Continued)

(52) U.S. Cl.
CPC ..... *H01F 1/14775* (2013.01); *C21D 8/1272* (2013.01); *C21D 9/46* (2013.01); *C22C 38/001* (2013.01); *C22C 38/002* (2013.01); *C22C 38/004* (2013.01); *C22C 38/005* (2013.01);
(Continued)

(58) Field of Classification Search
CPC ... C22C 38/00; C22C 38/001; C22C 38/002; C22C 38/004; C22C 38/02; C22C 38/04; C22C 38/06; C22C 38/12; C21D 8/1272; C21D 8/1222; C21D 8/1233; C21D 8/1261; C21D 9/46
See application file for complete search history.

(56) References Cited

U.S. PATENT DOCUMENTS 6,139,650 A 10/2000 Oda et al.
2003/0024606 A1 2/2003 Hayakawa et al.
(Continued)

FOREIGN PATENT DOCUMENTS

CN 1078270 11/1993
CN 1305019 7/2001
(Continued)

OTHER PUBLICATIONS

Taiwanese Office Action dated Jul. 4, 2014 along with an English translation from corresponding Taiwanese Patent Application No. 101335546.
(Continued)

*Primary Examiner* — Veronica F Faison
(74) *Attorney, Agent, or Firm* — DLA Piper LLP (US)

(57) ABSTRACT

A non-oriented electrical steel sheet has a chemical composition including, in mass %, C: 0.005% or less, Si: 5% or less, Al: 3% or less, Mn: 5% or less, S: 0.005% or less, P: 0.2% or less, N: 0.005% or less, Mo: 0.001 to 0.04%, Ti: 0.0030% or less, Nb: 0.0050% or less, V: 0.0050% or less, Zr: 0.0020% or less, one or both of Sb and Sn: 0.001 to 0.1% in total, and the balance being iron and incidental impurities.

1 Claim, 2 Drawing Sheets

(51) Int. Cl.

| | |
|---|---|
| ***C22C 38/60*** | (2006.01) |
| ***H01F 1/16*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/22*** | (2006.01) |
| ***C22C 38/24*** | (2006.01) |
| ***C22C 38/26*** | (2006.01) |
| ***C22C 38/34*** | (2006.01) |
| *C21D 8/12* | (2006.01) |

(52) U.S. Cl.

CPC ..... *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/34* (2013.01); *C22C 38/60* (2013.01); *H01F 1/16* (2013.01); *C21D 8/1222* (2013.01); *C21D 8/1233* (2013.01); *C21D 8/1261* (2013.01); *H01F 1/14791* (2013.01)

(56) References Cited

U.S. PATENT DOCUMENTS

| | | | | |
|---|---|---|---|---|
| 2005/0013722 | A1* | 1/2005 | Usami ..... | B23K 35/3053 420/93 |
| 2006/0124207 | A1* | 6/2006 | Takashima et al. ..... | 148/546 |
| 2009/0202383 | A1* | 8/2009 | Tanaka et al. ..... | 420/83 |
| 2010/0158744 | A1* | 6/2010 | Murakami ..... | 420/42 |

FOREIGN PATENT DOCUMENTS

| | | | |
|---|---|---|---|
| CN | 1083494 | C | 4/2002 |
| EP | 1 501 951 | A1 | 2/2005 |
| JP | 6-108149 | A | 4/1994 |
| JP | 8-97023 | A | 4/1996 |
| JP | 10-317111 | A | 12/1998 |
| JP | 2003-013190 | A | 1/2003 |
| JP | 2003-096548 | A | 4/2003 |
| JP | 3458682 | B2 | 8/2003 |
| JP | 2007-516345 | | 6/2007 |
| KR | 2001-0028570 | | 4/2001 |
| TW | 201139699 | | 11/2011 |
| WO | 93/08313 | | 4/1993 |
| WO | 2004/013365 | A1 | 2/2004 |
| WO | 2011-105327 | A1 | 9/2011 |

OTHER PUBLICATIONS

Notification of Reasons for Refusal of Japanese Application No. 2013-535913 dated Dec. 9, 2014 with English translation.

Japanese Office Action dated Sep. 16, 2014 from corresponding Japanese Patent Application No. 2013-535913 along with an English translation.

Chinese Office Action dated Mar. 11, 2015 of corresponding Chinese Application No. 201280046930.x along with its English translation.

Supplemental European Search Report dated Jun. 17, 2015 of corresponding European Application No. 12837342.0.

Notice of Grounds for Rejection dated Jul. 14, 2015 of corresponding Korean Patent Application No. 2014-7005986 along with an English translation.

Chinese Office Action dated Nov. 18, 2015 of corresponding Chinese Application No. 201280046930.X along with an English translation.

Korean Office Action dated Jan. 12, 2016 of corresponding Korean Application No. 2014-7005986 along with a Concise Statement of Relevance of Office Action in English.

Korean Office Action dated Jul. 6, 2016, of corresponding Korean Application No. 2014-7005986 along with a Concise Statement of Relevance of Office Action in English.

* cited by examiner

NON-ORIENTED ELECTRICAL STEEL SHEET

TECHNICAL FIELD

This disclosure relates to a non-oriented electrical steel sheet that has excellent iron loss properties, particularly in a high magnetic field.

BACKGROUND

Motors for vehicles such as hybrid electric vehicles or electric vehicles require large torque during startup and hill-climbing. Increasing motor size is effective in increasing motor torque. However, there is a problem in doing this as it increases vehicle weight and results in reduced fuel efficiency. For this reason, such motors can be designed for use in a non-conventional, high magnetic flux density range, such as 1.9 to 2.0 T, during startup and hill-climbing.

Meanwhile, an electrical steel sheet is punched into the shape of a core constituting a rotor of a motor so that it is used as the core material. However, due to the introduction of strain associated with such punching, iron loss property will deteriorate more than before the punching. Accordingly, the resulting motor may encounter a more significant increase in motor loss than is expected for the iron loss based on its material properties. As a measure to counter such difficulties, strain relief annealing may be performed at approximately 750° C. for 2 hours. In addition, by promoting the growth of crystal grains through the strain relief annealing, a further improvement in magnetic properties can be expected. For example, JP 3458682 B discloses a technique of improving grain growth properties during strain relief annealing and reducing iron loss by increasing the amount of Al to add.

However, our investigations revealed that while strain relief annealing reduces iron loss in a conventional magnetic flux density range from about 1.0 to 1.5 T, it can rather lead to increased iron loss in a high magnetic field range. Therefore, there is a need for a technique that ensures stable reduction of iron loss in a high magnetic field. In view of the foregoing, it could be helpful to provide a non-oriented electrical steel sheet with low iron loss, particularly in a high magnetic field range.

SUMMARY

We found that in improving high magnetic field properties, it is effective to inhibit formation of a nitride layer and an oxide layer on a surface layer of the steel sheet by adding a combination of Sn or Sb with Mo.

We thus provide:

[1] A non-oriented electrical steel sheet comprising a chemical composition including, in mass %, C: 0.005% or less, Si: 5% or less, Al: 3% or less, Mn: 5% or less, S: 0.005% or less, P: 0.2% or less, N: 0.005% or less, Mo: 0.001 to 0.04%, Ti: 0.0030% or less, Nb: 0.0050% or less, V: 0.0050% or less, Zr: 0.0020% or less, one or both of Sb and Sn: 0.001 to 0.1% in total, and the balance being iron and incidental impurities.

[2] The non-oriented electrical steel sheet according to item [1] above, wherein the chemical composition further includes, in mass %, one or more of Ca: 0.001 to 0.01%, Mg: 0.0005 to 0.005% and REM: 0.001 to 0.05%.

[3] The non-oriented electrical steel sheet according to item [1] or [2] above, wherein the chemical composition further includes, in mass %, Cr: 0.4 to 5%.

[4] The non-oriented electrical steel sheet according to item [1] or [2] above, wherein the chemical composition further includes, in mass %, one or more of Ni: 0.1 to 5%, Co: 0.1 to 5% and Cu: 0.05 to 2%.

[5] The non-oriented electrical steel sheet according to item (3) above, wherein the chemical composition further includes, in mass %, one or more of Ni: 0.1 to 5%, Co: 0.1 to 5% and Cu: 0.05 to 2%.

A non-oriented electrical steel sheet with low iron loss in a high magnetic field range may be manufactured while inhibiting the formation of a nitride layer and an oxide layer on a surface layer of the steel sheet by adding a combination of one or both of Sn and Sb with Mo.

DETAILED DESCRIPTION

Our steel sheets, methods and features thereof will now be described in detail below. Unless otherwise specified, "%" indicates "mass %" as used herein for the elements of the steel sheet described below.

First, experimental results will be described in detail below. That is, to investigate the influence of Sb on the magnetic properties, steel samples having a composition of C: 0.0015%, Si: 3.3%, Al: 1.0%, Mn: 0.2%, S: 0.0005%, P: 0.01%, N: 0.0020%, Ti: 0.0010%, Nb: 0.0005%, V: 0.0010%, Zr: 0.0005% and either of diverse content of Sb in the range of 0 to 0.1%, and steel samples having a composition of C: 0.0013%, Si: 3.3%, Al: 1.0%, Mn: 0.2%, S: 0.0006%, P: 0.01%, N: 0.0018%, Mo: 0.005%, Ti: 0.0010%, Nb: 0.0005%, V: 0.0010%, Zr: 0.0005% and either of diverse content of Sb in the range of 0 to 0.1% were prepared by melting and hot rolled in the laboratory. Subsequently, each of the hot rolled sheets was subjected to resultant hot rolled sheet annealing in an atmosphere of 100% $N_2$ at 1000° C. for 30 seconds and, further to cold rolling to be finished to a sheet thickness of 0.35 mm, followed by finish annealing in an atmosphere of 10% $H_2$ and 90% $N_2$ at 1000° C. for 10 seconds and strain relief annealing at 750° C. for 2 hours in DX gas ($H_2$: 4%, CO: 7%, $CO_2$: 8%, $N_2$: balance).

Figure 1:
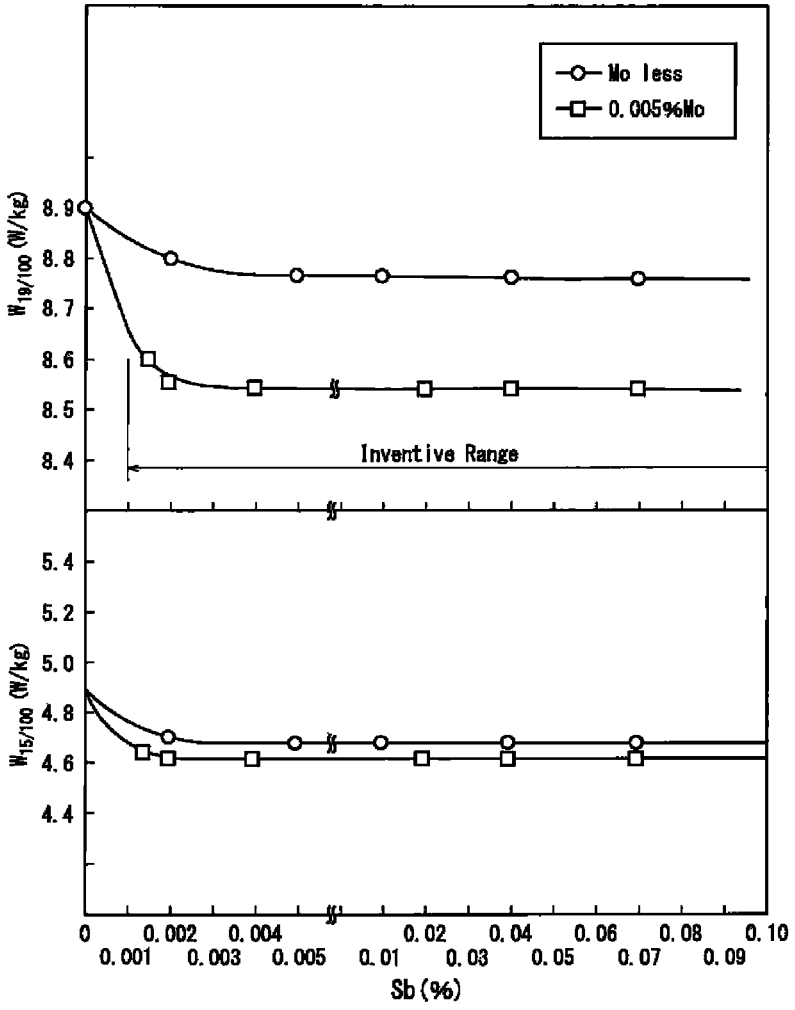
FIG. 1 is a graph illustrating a relationship between the amount of Sb added and the iron loss.

FIG. 1 illustrates the relationship between the amount of Sb added to the test specimens thus obtained and $W_{19/100}$ and $W_{15/100}$ values. The reason why iron loss properties were evaluated under the conditions of 1.9 T and 100 Hz is because products are generally used at around these magnetic flux density and frequency levels during startup and hill-climbing when hybrid electric vehicles require large torque. Also, the reason why $W_{15/100}$ is evaluated is because $W_{15/100}$ is a conventional evaluation point. It can be seen from FIG. 1 that the Mo-added steel, in particular, shows a significant reduction in $W_{19/100}$ where Sb is 0.001% or more. On the other hand, while the Mo-added steel also shows a reduction in $W_{15/100}$ where Sb is 0.001% or more, the magnitude of reduction is relatively small as compared to $W_{19/100}$.

Then, to investigate the cause of different effects obtained by adding a combination of Sb with Mo for different magnetic flux density levels, the structure of each steel sheet was analyzed with SEM. The results of the analysis are as follows: in each steel sample without Sb and Mo, a nitride layer and an oxide layer were observed on a surface layer of the steel sheet. In each steel sample with only Sb added, formation of a nitride layer was insignificant. Furthermore, in each steel sample with a combination of Sb with Mo added, formation of a nitride layer and formation of an oxide layer were both insignificant. The following assumptions are made regarding the cause of these nitride layers and oxide layers leading to a more significant increase in iron loss in a high magnetic field range.

That is, since the magnetic flux density is not high in a low magnetic field range around 1.5 T, it is possible to allow the passage of the magnetic flux sufficiently by allowing magnetization of only those crystal grains in the steel sheet in which domain wall displacement takes place easily. However, magnetization to a high magnetic field range of 1.9 T requires magnetization of the entire steel sheet. Accordingly, it is necessary to magnetize even those crystal grains in which domain wall displacement is difficult to occur including those in a nitride layer and an oxide layer formed on a surface layer of the steel sheet. It is thus believed that iron loss increased because of a larger amount of energy required to magnetize such crystal grains in which domain wall displacement is difficult to achieve to a high magnetic field range.

It is believed that although the nitride layer and the oxide layer were formed on the surface layer of the steel sheet during finish annealing and strain relief annealing, the iron loss in a high magnetic field was significantly reduced because nitridation was inhibited by addition of Sb and, furthermore, oxidation was inhibited by addition of Mo. In view of the above, the lower limit of Sb content is 0.001%. On the other hand, since Sb content exceeding 0.1% leads to unnecessarily increased costs, the upper limit of Sb content is 0.1%. Similar experiments were also conducted for Sn with similar results. That is, it turned out that Sb and Sn were equivalent elements.

Further, investigations were made on the proper amount of Mo to be added. That is, steel samples, each containing C: 0.0015%, Si: 3.3%, Al: 1.0%, Mn: 0.2%, S: 0.002%, P: 0.01%, N: 0.0020%, Ti: 0.0010%, Nb: 0.0005%, V: 0.0010%, Zr: 0.0005% Sb: 0.005% and either of diverse content of Mo of 0 to 0.1%, were prepared by melting and hot rolled in the laboratory. Subsequently, each of the hot rolled sheets was subjected to hot rolled sheet annealing at 1000° C. for 30 seconds in an atmosphere of 100% $N_2$ and, further, to cold rolling to be finished to a sheet thickness of 0.20 mm, followed by finish annealing at 1000° C. for 10 seconds in an atmosphere of 20% $H_2$ and 80% $N_2$ and strain relief annealing at 750° C. for 2 hours in DX gas.

Figure 2:
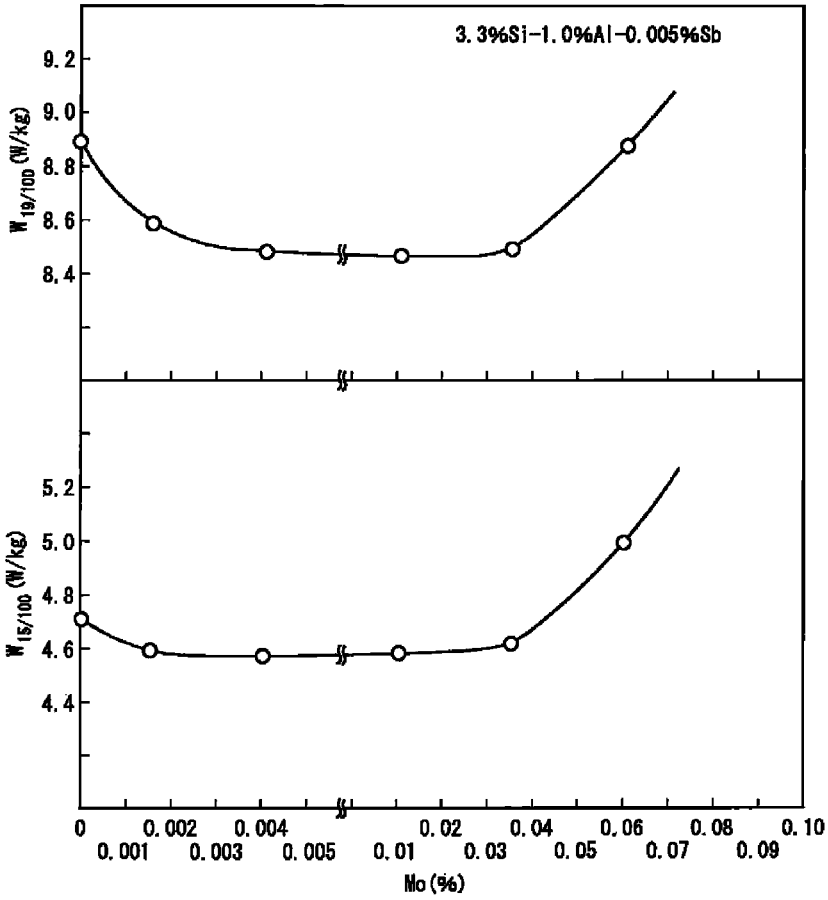
FIG. 2 is a graph illustrating a relationship between the amount of Mo added and the iron loss.

FIG. 2 illustrates the relationship between the amount of Mo added to the test specimens thus obtained and $W_{19/100}$ and $W_{15/100}$ values. It can be seen from FIG. 2 that $W_{19/100}$ decreases where Mo content is 0.001% or more and increases where Mo content is 0.04% or more. On the other hand, $W_{15/100}$ showed no reduction in iron loss by addition of Mo, while it turned to increase where Mo content is 0.04% or more. To investigate the cause of a reduction in iron loss in a high magnetic field range where Mo content is 0.001% or more, the structure of each steel sheet was analyzed with SEM. The results of the analysis are as follows: in each steel sample without Mo, formation of a nitride layer and an oxidation layer was observed on a surface layer of the steel sheet; whereas in each steel sample with Mo added, formation of a nitride layer and an oxidation layer was not observed. In this way, nitridation and oxidation are inhibited by addition of a combination of Sn with Mo, and this is believed to be the cause of reduced iron loss in a high magnetic field range. On the other hand, Mo-based carbonitrides were observed when analyzing the structure of a steel sample having Mo content of 0.04% or more. From this, it is believed that in each steel sample having Mo content of 0.04% or more, domain wall displacement was disturbed by the presence of carbonitrides, resulting in increased iron loss. In view of the above, Mo content is not less than 0.001% and not more than 0.04%.

Reasons for the limitation of each element will now be described below.

C: 0.005% or Less

C content is 0.005% or less from the viewpoint of preventing magnetic aging. It is difficult to industrially control C content to 0% and, therefore, C is often contained in an amount of 0.0005% or more.

Si: 5% or Less

Si is an element useful to increase specific resistance of a steel sheet. Thus, Si is preferably added in an amount of 1% or more. On the other hand, Si content exceeding 5% results in a decrease in magnetic flux density and an associated decrease in saturation magnetic flux density. Thus, the upper limit of Si content is 5%.

Al: 3% or Less

Al, like Si, is an element also useful to increase specific resistance of a steel sheet. Thus, Al is preferably added in an amount of 0.1% or more. On the other hand, Al content exceeding 3% results in a decrease in magnetic flux density and an associated decrease in saturation magnetic flux density. Thus, the upper limit of Al content is 3%.

Mn: 5% or Less

Mn is an element useful to increase specific resistance of a steel sheet. Thus, Mn is preferably added in an amount of 0.1% or more. On the other hand, Mn content exceeding 5% results in a decrease in magnetic flux density. Thus, the upper limit of Mn content is 5%.

S: 0.005% or Less

S is an element that would cause an increase in iron loss due to precipitation of MnS if added in an amount exceeding 0.005%. Thus, the upper limit of S content is 0.005%. While the lower limit of S content is preferably 0%, it is difficult to industrially control S content to 0%. Therefore, S is often contained in an amount of 0.0005% or more.

P: 0.2% or Less

P is an element that would harden a steel sheet if added in an amount exceeding 0.2%. Thus, P is preferably added in an amount not more than 0.2%, more preferably 0.1% or less. While the lower limit of P content is preferably 0%, it is difficult to industrially control P content to 0%. Therefore, P is often contained in an amount of 0.01% or more.

N: 0.005% or Less

N is an element that would lead to precipitation of a larger amount of AlN and increased iron loss if contained in a large amount. Thus, N content is 0.005% or less. While the lower limit of N content is preferably 0%, it is difficult to industrially control N content to 0%. Therefore, N is often contained in an amount of 0.001% or more.

Ti: 0.0030% or Less

Ti is an element that would lead to formation of Ti-based carbonitrides and increased iron loss if contained in an amount exceeding 0.0030%. Thus, the upper limit of Ti content is 0.0030%. While the lower limit of Ti content is preferably 0%, it is difficult to industrially control Ti content to 0%. Therefore, Ti is often contained in an amount of 0.0005% or more.

Nb: 0.0050% or Less

Nb is an element that would lead to formation of Nb-based carbonitrides and increased iron loss if contained in an amount exceeding 0.0050%. Thus, the upper limit of Nb content is 0.0050%. While the lower limit of Nb content is preferably 0%, it is difficult to industrially control Nb content to 0%. Therefore, Nb is often contained in an amount of 0.0001% or more.

V: 0.0050% or Less

V is an element that would lead to formation of V-based carbonitrides and increased iron loss if contained in an amount exceeding 0.0050%. Thus, the upper limit of V content is 0.0050%. While the lower limit of V content is preferably 0%, it is difficult to industrially control V content to 0%. Therefore, V is often contained in an amount of 0.0005% or more.

Zr: 0.0020% or Less

Zr is an element that would enhance the nitride forming ability if incorporated. In that case, it is not possible to inhibit the nitridation of a surface layer of a steel sample in a sufficient manner even with addition of Sb, Sn and Mo. This results in an increase in iron loss in a high magnetic field range. Thus, Zr content is 0.002% or less. While the lower limit of Zr content is preferably 0%, it is difficult to industrially control Zr content to 0%. Therefore, Zr is often contained in an amount of 0.0005% or more.

One or Both of Sb and Sn: 0.001 to 0.1% in Total

Sn, like Sb, is an element that would prevent nitridation during finish annealing and reduce iron loss if added in an amount of 0.001% or more. Thus, the lower limit of Sn content is 0.001%. On the other hand, since Sn content exceeding 0.1% leads to unnecessarily increased costs, the upper limit of Sn content is 0.1%.

The following elements are additional elements.

One or More of Ca: 0.001 to 0.01%, Mg: 0.0005 to 0.005% and REM: 0.001 to 0.05%

Ca is an element that precipitates as CaS to suppress precipitation of fine sulfides so that iron loss is reduced. To this end, Ca is preferably added in an amount of 0.001% or more. On the other hand, Ca content exceeding 0.01% leads to precipitation of a larger amount of CaS, which increases rather than reduces iron loss. Thus, the upper limit of Ca is preferably 0.01%.

Mg is an element useful to reduce iron loss by controlling the spherical shape of inclusions. To this end, Mg content is preferably added in an amount of 0.0005% or more. On the other hand, since Mg content exceeding 0.005% leads to increased costs, the upper limit of Mg content is preferably 0.005%.

REM, or rare earth element, is an element useful to reduce iron loss by coarsening sulfides. To this end, REM is preferably added in an amount of 0.001% or more. On the other hand, if REM is added in an amount exceeding 0.05%, this ends up in unnecessarily increased costs since the effect attained by addition of REM reaches a saturation point. Thus, the upper limit of REM content is preferably 0.05%.

Cr: 0.4 to 5%

Cr is an element useful to reduce iron loss by increasing specific resistance. To this end, Cr is preferably added in an amount of 0.4% or more. On the other hand, Cr content exceeding 5% results in a decrease in magnetic flux density. Thus, the upper limit of Cr content is preferably 5%. Additionally, from the viewpoint of improving magnetic properties by inhibiting formation of fine Cr carbonitrides that would otherwise easily occur when a trace of Cr is contained, it is more preferable to either reduce Cr content to 0.05% or less, or add Cr in an amount of 0.4 to 5%. If Cr content is reduced to 0.05% or less, the lower limit of Cr content is preferably 0%. However, it is difficult to industrially control Cr content to 0% and, therefore, Cr is often contained in an amount of 0.005% or more.

Further, from the viewpoint of improved magnetic properties, Ni, Co and Cu may also be added. These elements are preferably added in the following range: Ni: 0.1 to 5%, Co: 0.1 to 5% and Cu: 0.05 to 2%.

A method of manufacturing our steel sheets will now be described below. It is important to control the chemical composition within the above-specified ranges. However, manufacturing conditions are not necessarily limited to particular conditions. Rather, it is possible to manufacture the steel sheets in accordance with the common practices in the field of non-oriented electrical steel sheets. That is, molten steel is subjected to blowing in a converter and subsequent degassing treatment where it is adjusted to have a predetermined chemical composition, followed by casting and hot rolling. A finish annealing temperature and a coiling temperature during the hot rolling do not have to be explicitly specified. Rather, normally used temperatures may be used. The hot rolling may be followed by hot rolled sheet annealing, although this is not essential. Then, the hot rolled steel sheet is subjected to cold rolling once, or twice or more with intermediate annealing performed therebetween, to be finished to a predetermined sheet thickness, followed by finish annealing.

EXAMPLES

Molten steel, which was obtained by being blown in a converter, was subjected to degassing treatment and subsequent casting to produce steel slabs, each having a chemical composition as shown in Tables 1-1 and 1-2. Then, each of the steel slabs was subjected to slab heating at 1140° C. for 1 hour and then hot rolling to be finished to a sheet thickness of 2.0 mm. In this case, the hot rolling finishing temperature was 800° C. and each hot rolled sheet was coiled at 610° C. after finish rolling. Following coiling, each sheet was subjected to hot rolled sheet annealing in an atmosphere of 100% $N_2$ at 1000° C. for 30 seconds. Then, each sheet was subjected to cold rolling to be finished to a sheet thickness of 0.30 to 0.35 mm and finish annealing in an atmosphere of 10% $H_2$ and 90% $N_2$ under the conditions as shown in Tables 2-1 and 2-2. Then, each sheet was evaluated for its magnetic properties as finish annealed or after undergoing strain relief annealing subsequent to the finish annealing. For magnetometry, Epstein measurement was performed where an Epstein sample was cut out from each sheet in a rolling direction and a transverse direction (a direction perpendicular to the rolling direction).

TABLE 1-1

| ID | C | Si | Al | Mn | S | P | N | Mo | Ti | Nb | V | Zr | Sb | Sn | Cr | Others |
|---|---|---|---|---|---|---|---|---|---|---|---|---|---|---|---|---|
| | Chemical Composition (mass %) | | | | | | | | | | | | | | | |
| 1 | 0.0018 | 3.05 | 0.50 | 0.20 | 0.0008 | 0.012 | 0.0015 | — | — | — | — | — | — | — | 0.004 | |
| 2 | 0.0013 | 3.01 | 0.50 | 0.20 | 0.0007 | 0.012 | 0.0019 | — | — | — | — | — | — | — | 0.004 | |
| 3 | 0.0016 | 2.99 | 0.50 | 0.19 | 0.0008 | 0.012 | 0.0021 | — | — | — | — | — | — | 0.0100 | 0.004 | |
| 4 | 0.0018 | 2.98 | 0.50 | 0.19 | 0.0005 | 0.011 | 0.0020 | 0.0010 | — | — | — | — | — | 0.0100 | 0.004 | |
| 5 | 0.0015 | 3.10 | 0.50 | 0.21 | 0.0006 | 0.010 | 0.0021 | 0.0030 | — | — | — | — | — | 0.0100 | 0.004 | |
| 6 | 0.0018 | 3.07 | 0.50 | 0.21 | 0.0004 | 0.010 | 0.0018 | 0.0200 | — | — | — | — | — | 0.0100 | 0.004 | |
| 7 | 0.0018 | 3.06 | 0.50 | 0.21 | 0.0009 | 0.011 | 0.0012 | 0.0500 | — | — | — | — | — | 0.0100 | 0.004 | |
| 8 | 0.0012 | 3.00 | 0.50 | 0.19 | 0.0008 | 0.010 | 0.0019 | 0.0030 | — | — | — | — | 0.0050 | — | 0.004 | |
| 9 | 0.0012 | 3.00 | 0.50 | 0.19 | 0.0008 | 0.010 | 0.0019 | 0.0030 | — | — | — | — | 0.0500 | — | 0.004 | |
| 10 | 0.0020 | 3.00 | 0.50 | 0.18 | 0.0007 | 0.011 | 0.0018 | 0.0030 | — | — | — | — | 0.0050 | 0.0100 | 0.004 | |
| 11 | 0.0021 | 3.06 | 0.50 | 0.19 | 0.0006 | 0.010 | 0.0018 | 0.0030 | — | — | — | — | — | 0.0100 | 0.004 | REM: 0.0020 |
| 12 | 0.0019 | 3.02 | 0.50 | 0.20 | 0.0007 | 0.012 | 0.0022 | 0.0030 | — | — | — | — | — | 0.0100 | 0.004 | REM: 0.0100 |
| 13 | 0.0013 | 3.03 | 0.50 | 0.20 | 0.0007 | 0.012 | 0.0020 | 0.0030 | — | — | — | — | — | 0.0250 | 0.004 | Ca: 0.0015 |
| 14 | 0.0016 | 2.99 | 0.50 | 0.20 | 0.0007 | 0.010 | 0.0017 | 0.0030 | — | — | — | — | — | 0.0250 | 0.004 | Ca: 0.0030 |
| 15 | 0.0018 | 3.01 | 0.50 | 0.20 | 0.0007 | 0.011 | 0.0015 | 0.0030 | — | — | — | — | — | 0.0250 | 0.004 | Mg: 0.0008 |
| 16 | 0.0019 | 3.00 | 0.50 | 0.19 | 0.0007 | 0.012 | 0.0012 | 0.0030 | — | — | — | — | — | 0.0250 | 0.004 | Mg: 0.0020 |
| 17 | 0.0018 | 3.04 | 0.50 | 0.18 | 0.0008 | 0.012 | 0.0019 | 0.0030 | — | — | — | — | 0.0010 | — | 0.004 | |
| 18 | 0.0018 | 3.00 | 0.50 | 0.17 | 0.0007 | 0.012 | 0.0018 | 0.0030 | — | — | — | — | — | 0.0020 | 0.004 | |
| 19 | 0.0022 | 3.03 | 0.50 | 0.19 | 0.0005 | 0.012 | 0.0021 | 0.0030 | — | — | — | — | — | 0.0350 | 0.004 | |
| 20 | 0.0022 | 3.03 | 0.50 | 0.19 | 0.0005 | 0.012 | 0.0021 | 0.0030 | — | — | — | — | — | 0.0550 | 0.004 | |
| 21 | 0.0022 | 3.03 | 0.50 | 0.19 | 0.0005 | 0.012 | 0.0021 | 0.0030 | — | — | — | — | — | 0.0780 | 0.004 | |
| 22 | 0.0016 | 3.01 | 0.50 | 0.18 | 0.0007 | 0.012 | 0.0014 | 0.0030 | 0.0010 | — | — | — | — | 0.0350 | 0.004 | |
| 23 | 0.0016 | 2.98 | 0.50 | 0.19 | 0.0007 | 0.012 | 0.0013 | 0.0030 | 0.0040 | — | — | — | — | 0.0350 | 0.004 | |
| 24 | 0.0014 | 3.00 | 0.50 | 0.20 | 0.0005 | 0.012 | 0.0018 | 0.0030 | — | 0.0005 | — | — | — | 0.0350 | 0.004 | |
| 25 | 0.0015 | 3.00 | 0.50 | 0.17 | 0.0007 | 0.012 | 0.0020 | 0.0030 | — | 0.0030 | — | — | — | 0.0350 | 0.004 | |
| 26 | 0.0015 | 3.00 | 0.50 | 0.17 | 0.0005 | 0.012 | 0.0020 | 0.0030 | — | 0.0060 | — | — | — | 0.0350 | 0.004 | |
| 27 | 0.0016 | 3.00 | 0.50 | 0.20 | 0.0005 | 0.012 | 0.0018 | 0.0030 | — | — | 0.0020 | — | — | 0.0350 | 0.004 | |
| 28 | 0.0016 | 3.00 | 0.50 | 0.20 | 0.0007 | 0.012 | 0.0022 | 0.0030 | — | — | 0.0040 | — | — | 0.0350 | 0.004 | |
| 29 | 0.0016 | 3.00 | 0.50 | 0.20 | 0.0007 | 0.012 | 0.0022 | 0.0030 | — | — | 0.0060 | — | — | 0.0350 | 0.004 | |
| 30 | 0.0016 | 3.00 | 0.50 | 0.20 | 0.0007 | 0.012 | 0.0018 | 0.0030 | — | — | — | 0.0010 | — | 0.0350 | 0.004 | |

TABLE 1-2

| ID | C | Si | Al | Mn | S | P | N | Mo | Ti | Nb | V | Zr | Sb | Sn | Cr | Others |
|---|---|---|---|---|---|---|---|---|---|---|---|---|---|---|---|---|
| | Chemical Composition (mass %) | | | | | | | | | | | | | | | |
| 31 | 0.0016 | 3.00 | 0.50 | 0.20 | 0.0007 | 0.012 | 0.0018 | 0.0030 | — | — | — | 0.0030 | — | 0.0350 | 0.004 | |
| 32 | 0.0016 | 3.00 | 0.50 | 0.20 | 0.0007 | 0.012 | 0.0018 | 0.0030 | — | — | — | — | — | 0.0350 | 0.004 | |
| 33 | 0.0021 | 2.00 | 1.50 | 0.19 | 0.0007 | 0.012 | 0.0020 | 0.0030 | — | — | 0.0010 | — | — | 0.0350 | 0.004 | |
| 34 | 0.0021 | 4.00 | — | 0.19 | 0.0007 | 0.012 | 0.0021 | 0.0030 | — | — | 0.0010 | — | — | 0.0350 | 0.004 | |
| 35 | 0.0021 | 5.50 | — | 0.19 | 0.0007 | 0.012 | 0.0018 | 0.0030 | — | — | 0.0010 | — | — | 0.0350 | 0.004 | |
| 36 | 0.0060 | 3.00 | 0.55 | 0.19 | 0.0007 | 0.012 | 0.0012 | 0.0030 | — | — | 0.0010 | — | — | 0.0350 | 0.004 | |
| 37 | 0.0021 | 1.00 | 2.80 | 0.19 | 0.0007 | 0.012 | 0.0022 | 0.0030 | — | — | 0.0010 | — | — | 0.0350 | 0.004 | |
| 38 | 0.0021 | 1.50 | 3.50 | 0.19 | 0.0007 | 0.012 | 0.0026 | 0.0030 | — | — | 0.0010 | — | — | 0.0350 | 0.004 | |
| 39 | 0.0015 | 3.00 | 0.50 | 0.21 | 0.0007 | 0.010 | 0.0018 | 0.0030 | — | — | 0.0010 | — | — | 0.0100 | 0.500 | |
| 40 | 0.0015 | 2.30 | 0.50 | 0.21 | 0.0007 | 0.010 | 0.0022 | 0.0030 | — | — | 0.0010 | — | — | 0.0100 | 2.000 | |
| 41 | 0.0015 | 1.00 | 0.50 | 0.21 | 0.0007 | 0.010 | 0.0016 | 0.0030 | — | — | 0.0010 | — | — | 0.0100 | 6.000 | |
| 42 | 0.0015 | 3.10 | 0.50 | 0.21 | 0.0007 | 0.010 | 0.0016 | 0.0030 | — | — | 0.0010 | — | — | 0.0100 | 0.004 | |
| 43 | 0.0015 | 3.10 | 0.50 | 0.21 | 0.0008 | 0.010 | 0.0060 | 0.0030 | — | — | — | — | — | 0.0100 | 0.004 | |
| 44 | 0.0015 | 3.10 | 0.50 | 0.21 | 0.0160 | 0.010 | 0.0020 | 0.0030 | — | — | — | — | — | 0.0100 | 0.004 | |
| 45 | 0.0015 | 2.80 | 0.50 | 1.00 | 0.0007 | 0.010 | 0.0021 | 0.0030 | — | — | — | — | — | 0.0100 | 0.004 | |
| 46 | 0.0015 | 2.40 | 0.50 | 2.50 | 0.0008 | 0.010 | 0.0021 | 0.0030 | — | — | — | — | — | 0.0100 | 0.004 | |
| 47 | 0.0015 | 2.50 | 1.00 | 6.00 | 0.0009 | 0.025 | 0.0021 | 0.0030 | — | — | — | — | — | 0.0100 | 0.004 | |
| 48 | 0.0015 | 2.50 | 0.50 | 0.21 | 0.0006 | 0.050 | 0.0021 | — | — | — | — | — | — | — | 0.004 | |
| 49 | 0.0015 | 2.50 | 0.50 | 0.21 | 0.0005 | 0.050 | 0.0021 | 0.0030 | — | — | — | — | — | 0.0100 | 0.004 | |
| 50 | 0.0014 | 3.00 | 0.50 | 0.20 | 0.0006 | 0.011 | 0.0018 | 0.0030 | — | — | — | — | — | 0.0100 | 0.004 | Ni: 0.30 |
| 51 | 0.0013 | 3.10 | 0.51 | 0.21 | 0.0005 | 0.010 | 0.0015 | 0.0035 | — | — | — | — | — | 0.0100 | 0.004 | Co: 0.30 |
| 52 | 0.0015 | 3.05 | 0.49 | 0.20 | 0.0004 | 0.012 | 0.0020 | 0.0030 | — | — | — | — | — | 0.0100 | 0.004 | Cu: 0.20 |

TABLE 2-1

| ID | Sheet Thickness (mm) | Finish Annealing Temp. (° C.) × 10 sec | Strain Relief Annealing Temp. (° C.) × 2 h | Strain Relief Annealing Atmosphere | $W_{15/100}$ (W/kg) | $W_{19/100}$ (W/kg) | $B_{50}$ (T) | Remarks |
|---|---|---|---|---|---|---|---|---|
| 1 | 0.35 | 950 | — | — | 5.40 | 8.65 | 1.67 | Comparative Example |
| 2 | 0.35 | 950 | 750 | DX | 4.90 | 8.90 | 1.67 | Comparative Example |
| 3 | 0.35 | 950 | 750 | DX | 4.70 | 8.80 | 1.67 | Comparative Example |
| 4 | 0.35 | 950 | 750 | DX | 4.65 | 8.55 | 1.67 | Example |
| 5 | 0.35 | 950 | 750 | DX | 4.65 | 8.45 | 1.67 | Example |
| 6 | 0.35 | 950 | 750 | DX | 4.70 | 8.44 | 1.67 | Example |
| 7 | 0.35 | 950 | 750 | DX | 4.95 | 9.25 | 1.67 | Comparative Example |
| 8 | 0.35 | 950 | 750 | DX | 4.70 | 8.50 | 1.67 | Example |
| 9 | 0.35 | 950 | 750 | DX | 4.62 | 8.43 | 1.67 | Example |
| 10 | 0.35 | 950 | 750 | DX | 4.65 | 8.45 | 1.67 | Example |
| 11 | 0.35 | 950 | 750 | DX | 4.60 | 8.43 | 1.67 | Example |
| 12 | 0.35 | 950 | 750 | DX | 4.52 | 8.42 | 1.67 | Example |
| 13 | 0.35 | 950 | 750 | DX | 4.60 | 8.45 | 1.67 | Example |
| 14 | 0.35 | 950 | 750 | DX | 4.52 | 8.41 | 1.67 | Example |
| 15 | 0.35 | 950 | 750 | DX | 4.54 | 8.43 | 1.67 | Example |
| 16 | 0.35 | 950 | 750 | DX | 4.56 | 8.46 | 1.67 | Example |
| 17 | 0.35 | 950 | 750 | DX | 4.71 | 8.46 | 1.67 | Example |
| 18 | 0.35 | 950 | 750 | DX | 4.72 | 8.47 | 1.67 | Example |
| 19 | 0.35 | 950 | 750 | DX | 4.65 | 8.45 | 1.67 | Example |
| 20 | 0.35 | 950 | 750 | DX | 4.64 | 8.44 | 1.67 | Example |
| 21 | 0.35 | 950 | 750 | DX | 4.66 | 8.45 | 1.67 | Example |
| 22 | 0.35 | 950 | 750 | DX | 4.66 | 8.45 | 1.67 | Example |
| 23 | 0.35 | 950 | 750 | DX | 5.03 | 8.82 | 1.66 | Comparative Example |
| 24 | 0.35 | 950 | 750 | DX | 4.64 | 8.45 | 1.67 | Example |
| 25 | 0.35 | 950 | 750 | DX | 4.92 | 8.60 | 1.67 | Example |
| 26 | 0.35 | 950 | 750 | DX | 4.98 | 8.70 | 1.66 | Comparative Example |
| 27 | 0.35 | 950 | 750 | DX | 4.66 | 8.46 | 1.67 | Example |
| 28 | 0.35 | 950 | 750 | DX | 4.67 | 8.47 | 1.67 | Example |
| 29 | 0.35 | 950 | 750 | DX | 4.89 | 8.70 | 1.67 | Comparative Example |
| 30 | 0.35 | 950 | 750 | DX | 4.65 | 8.45 | 1.67 | Example |

* DX ($H_2$: 4%, CO: 7%, $CO_2$: 8%, $N_2$: balance)

TABLE 2-2

| ID | Sheet Thickness (mm) | Finish Annealing Temp. (° C.) × 10 sec | Strain Relief Annealing Temp. (° C.) × 2 h | Strain Relief Annealing Atmosphere | $W_{15/100}$ (W/kg) | $W_{19/100}$ (W/kg) | $B_{50}$ (T) | Remarks |
|---|---|---|---|---|---|---|---|---|
| 31 | 0.35 | 950 | 750 | DX | 4.72 | 8.71 | 1.67 | Comparative Example |
| 32 | 0.35 | 950 | 750 | DX | 4.66 | 8.46 | 1.67 | Example |
| 33 | 0.35 | 950 | 750 | DX | 4.66 | 8.47 | 1.66 | Example |
| 34 | 0.35 | 950 | 750 | DX | 4.62 | 8.40 | 1.68 | Example |
| 35 | — | — | — | — | — | — | — | Comparative Example (rolling cracks) |
| 36 | 0.35 | 950 | 750 | DX | 5.20 | 9.10 | 1.67 | Comparative Example |
| 37 | 0.35 | 950 | 750 | DX | 4.75 | 8.45 | 1.65 | Example |
| 38 | 0.35 | 950 | 750 | DX | 4.65 | 8.44 | 1.59 | Comparative Example |
| 39 | 0.35 | 950 | 750 | DX | 4.60 | 8.40 | 1.66 | Example |
| 40 | 0.35 | 950 | 750 | DX | 4.55 | 8.38 | 1.66 | Example |
| 41 | 0.35 | 950 | 750 | DX | 4.52 | 8.21 | 1.63 | Example |
| 42 | 0.35 | 950 | 750 | DX | 4.65 | 8.45 | 1.67 | Example |
| 43 | 0.35 | 950 | 750 | DX | 5.12 | 8.92 | 1.65 | Comparative Example |
| 44 | 0.35 | 950 | 750 | DX | 5.62 | 9.36 | 1.65 | Comparative Example |
| 45 | 0.35 | 950 | 750 | DX | 4.62 | 8.43 | 1.67 | Example |
| 46 | 0.35 | 950 | 750 | DX | 4.60 | 8.40 | 1.66 | Example |
| 47 | 0.35 | 950 | 750 | DX | 5.36 | 9.12 | 1.53 | Comparative Example |
| 48 | 0.30 | 1000 | — | — | 4.90 | 8.60 | 1.67 | Comparative Example |
| 49 | 0.30 | 1000 | — | — | 4.70 | 8.30 | 1.67 | Example |
| 50 | 0.35 | 950 | 750 | DX | 4.50 | 8.41 | 1.68 | Example |
| 51 | 0.35 | 950 | 750 | DX | 4.51 | 8.40 | 1.68 | Example |
| 52 | 0.35 | 950 | 750 | DX | 4.52 | 8.43 | 1.68 | Example |

* DX ($H_2$: 4%, CO: 7%, $CO_2$: 8%, $N_2$: balance)

In Comparative Examples indicated by IDs 1 to 3 in Table 2-1, the content(s) of one or both of Sn and Sb as well as the content of Mo fall below our range. Therefore, the value of $W_{19/100}$ is high. In Comparative Example indicated by ID 7, Mo content exceeds our range. Therefore, the value of $W_{19/100}$ is high. In Comparative Example indicated by ID 23, Ti content exceeds our range. Therefore, the values of $W_{15/100}$ and $W_{19/100}$ are high. In Comparative Example indicated by ID 26, Nb content exceeds our range. Therefore, the value of $W_{19/100}$ is high. In Comparative Example indicated by ID 29, V content exceeds our range. Therefore, the value of $W_{19/100}$ is high. In Comparative Example indicated by ID 31 in Table 2-2, Zr content exceeds our range. Therefore, the value of $W_{19/100}$ is high. In Comparative Example indicated by ID 36, C content exceeds our range. Therefore, the values of $W_{15/100}$ and $W_{19/100}$ are high. In Comparative Example indicated by ID 38, Al content exceeds our range. Therefore, the value of magnetic flux density $B_{50}$ is low. In Comparative Example indicated by ID 43, N content exceeds our range. Therefore, the values of $W_{15/100}$ and $W_{19/100}$ are high. In Comparative Example indicated by ID 44, S content exceeds our range. Therefore, the values of $W_{15/100}$ and $W_{19/100}$ are high. In Comparative Example indicated by ID 47, Mn content exceeds our range. Therefore, the value of magnetic flux density $B_{50}$ is low and the values of $W_{15/100}$ and $W_{19/100}$ are both high. In addition, in Comparative Example indicated by ID 48, which has a sheet thickness different from those of the other examples indicated by IDs 1 to 47, the content of one or both of Sn and Sb as well as the content of Mo fall below our range. Therefore, the values of $W_{15/100}$ and $W_{19/100}$ are higher than those of Example indicated by ID 49 having the same sheet thickness.

In contrast, all Examples have good values of magnetic flux density $B_{50}$ and $W_{19/100}$. As a result, materials with lower iron loss in a high magnetic field range were obtained.

The invention claimed is:

1. A non-oriented electrical steel sheet comprising a chemical composition consisting essentially of, in mass %, C: 0.005% or less, Si: 5% or less, Al: 3% or less, Mn: 5% or less, S: 0.005% or less, P: 0. 2% or less, N: 0.005% or less, Mo: 0.001 to 0.04%, and one or both of Sb and Sn: 0.001 to 0.1% in total;

optionally one or more of Ca: 0.001 to 0.01%, Mg: 0.0005 to 0.005% and REM: 0.001 to 0,05%:

optionally Cr: 0.4 to 5%:

optionally one or both of Ni: 0.1 to 5% and Co: 0.1 to 5%; and the balance being iron and incidental impurities, wherein $W_{19/100}$ of the non-oriented electrical steel sheet is equal to or lower than 8.60 W/kg.

* * * * *